US007770763B2

(12) United States Patent
Faure

(10) Patent No.: US 7,770,763 B2
(45) Date of Patent: Aug. 10, 2010

(54) PRECISION COVER WITH A SPOUT FOR CLOSING A CONTAINER OF LIQUID OR PARTICULATE PRODUCT

(75) Inventor: Pierre-Erik Faure, Chartres (FR)

(73) Assignee: Fillon Investissement S.A., Faverolles (FR)

( * ) Notice: Subject to any disclaimer, the term of this patent is extended or adjusted under 35 U.S.C. 154(b) by 372 days.

(21) Appl. No.: 11/914,234

(22) PCT Filed: May 11, 2005

(86) PCT No.: PCT/FR2005/001178

§ 371 (c)(1),
(2), (4) Date: Nov. 13, 2007

(87) PCT Pub. No.: WO2006/120306

PCT Pub. Date: Nov. 16, 2006

(65) Prior Publication Data

US 2008/0190969 A1 Aug. 14, 2008

(51) Int. Cl.
*B65D 83/00* (2006.01)

(52) U.S. Cl. ..... 222/472; 222/515

(58) Field of Classification Search ..... 222/472, 222/473, 474, 475.1, 544, 556, 515, 517, 222/545, 559

See application file for complete search history.

(56) References Cited

U.S. PATENT DOCUMENTS 1,742,562 A * 1/1930 Savoy ..... 222/505
2,133,772 A * 10/1938 Pershall ..... 222/505
2,154,581 A * 4/1939 Pershall ..... 222/473
2,257,370 A * 9/1941 De Kay ..... 222/505
3,021,118 A * 2/1962 Dedoes ..... 366/247
4,384,662 A * 5/1983 Boudin et al. ..... 222/484
4,750,648 A * 6/1988 Krydiak ..... 222/484
4,793,528 A * 12/1988 Krzywdziak ..... 222/487
4,921,146 A * 5/1990 Salzmann ..... 222/473
5,199,597 A * 4/1993 Gladish ..... 220/715
5,358,153 A * 10/1994 Caldwell et al. ..... 222/505
5,413,257 A * 5/1995 Amberger et al. ..... 222/472

(Continued)

FOREIGN PATENT DOCUMENTS

FR 2 474 632 A 7/1981

*Primary Examiner*—Kevin P Shaver
*Assistant Examiner*—Donnell Long
(74) *Attorney, Agent, or Firm*—Young & Thompson

(57) ABSTRACT

The invention relates to a precision cover (1) with a spout (5) for closing a container of liquid or particulate product of the type in which the top of the cover forms a spout (5) with a sliding seal (2) that is acted upon by a spring (4) and whose motion is controlled by a pivoting opening lever (3). This cover (1) is characterized in that the pivoting opening lever (3) controls at least two different modes of operation of the sliding seal (2), one in which, for a given angular shift of the control lever (3), the seal (2) is moved by a low value relative to the opening of the spout (5), and the other in which, for the same angular shift of the control lever (3), the sliding seal (2) is moved by a higher value relative to the opening of the spout (5) so as to allow the operator to meter the flow rate of the container's contents with very high precision in the first mode and with a high value of opening in the second mode.

10 Claims, 2 Drawing Sheets

U.S. PATENT DOCUMENTS 5,503,474 A * 4/1996 Krzywdziak ..... 366/347
5,839,825 A * 11/1998 Krzywdziak ..... 366/247
6,095,373 A * 8/2000 Boers ..... 222/166
6,206,250 B1 * 3/2001 Boers ..... 222/473
6,290,110 B1 * 9/2001 Boers ..... 222/559
6,471,099 B2 * 10/2002 Arabnia ..... 222/484
6,474,516 B2 * 11/2002 Boers ..... 222/559
6,755,326 B2 * 6/2004 Boers ..... 222/135
2003/0071091 A1 * 4/2003 Boers ..... 222/559
2006/0000838 A1 * 1/2006 Santrach ..... 220/700

* cited by examiner

PRECISION COVER WITH A SPOUT FOR CLOSING A CONTAINER OF LIQUID OR PARTICULATE PRODUCT

BACKGROUND OF THE INVENTION

This invention relates to a precision cover with a spout for closing a container of liquid or particulate product.

It relates more particularly to a precision cover with a spout in which the top of the cover forms a spout with a sliding seal that is acted upon by a spring whose motion is controlled by a pivoting opening lever.

Such closing covers should both perform the function of precision-metering cover and sealing cover. In certain applications, in particular during use of these covers for closing a paint container, it is necessary to be able to close the spout of the cover immediately and in a perfectly sealed manner to avoid any evaporation or drying of the paint. To obtain a precise metering, it is preferable to use, during the phase of opening the spout of the cover, a reduction ratio of the travel, namely a long travel of the lever combined with moving the seal of the spout a short way. However, if the movement of the lever remains proportional to the travel of the seal, it becomes necessary to use a long travel of the lever to obtain a complete opening of the spout, which should be sized to allow an adequate maximum flow rate. This proves as difficult for the operator to handle as it is cumbersome. As a result, the covers, such as those described in Patent FR-A-2,555,141, are not satisfactory for a small opening of the seal since it is difficult to adjust this opening because moving the lever a short way causes the seal to be moved a long way.

To overcome this problem, it was provided, in particular in the patents FR-A-2,474,632, WO 97/134775 and U.S. Pat. No. 5,413,257, to use a cover whose seal is equipped with an actuating device designed such that in closing position, the seal is kept in airtight contact on the section of the opening of the spout and such that, starting from this position, in a first phase, the seal slides on the section of the opening of the spout, and, in a second phase, the seal performs a swinging movement. The problem, in particular with a cover of the type of the one that is described in the U.S. Pat. No. 5,413,254, is that the paint tends to accumulate in the end zone of the seal close to the pivot axis such that eventually, the seal no longer closes the spout in an airtight manner.

The solutions with pivoting, such as those described in the patent FR-A-2,474,632, bring the dispersion of the paint to the surface of the cover. Actually, the seal of the spout is in contact with the paint such that when it is separated from the spout, drips occur and the paint spills on the outside of the spout and on the surface of the cover.

SUMMARY OF THE INVENTION

One object of this invention is therefore to propose a closing cover that ensures a double function of metering cover and sealing cover whose design makes it possible to control perfectly the metering as well as the force to be exerted on the lever at the beginning of the travel of the lever because of moving the lever a long way combined with moving the seal a short way and to make possible a sufficiently large opening during the continuation of the travel of the lever while causing the seal to move a long way for a short travel of the lever.

For this purpose, the invention has as its object a precision cover with a spout for closing a container of liquid or particulate product of the type in which the top of the cover forms a spout with a sliding seal that is acted upon by a spring and controlled in motion by a pivoting opening lever, characterized in that the pivoting opening lever controls at least two different modes of operation of the sliding seal, one in which, for a given angular shift of the control lever, the seal is moved by a low value relative to the opening of the spout, and the other in which for the same angular shift of the control lever, the sliding seal is moved by a larger value relative to the opening of the spout so as to allow the operator to meter the flow of the container's contents with very high precision.

Thanks to the fact that the seal is kept sliding against the spout over the entire distance that it travels, the drawbacks that are observed in the prior art, in particular the phenomena of where there is no airtight closure due to the accumulation of paint, are eliminated.

BRIEF DESCRIPTION OF THE DRAWINGS

The invention will be better understood from reading the following description of embodiments, with reference to the accompanying drawings, in which.

DETAILED DESCRIPTION OF THE PREFERRED EMBODIMENTS

Figure 1:
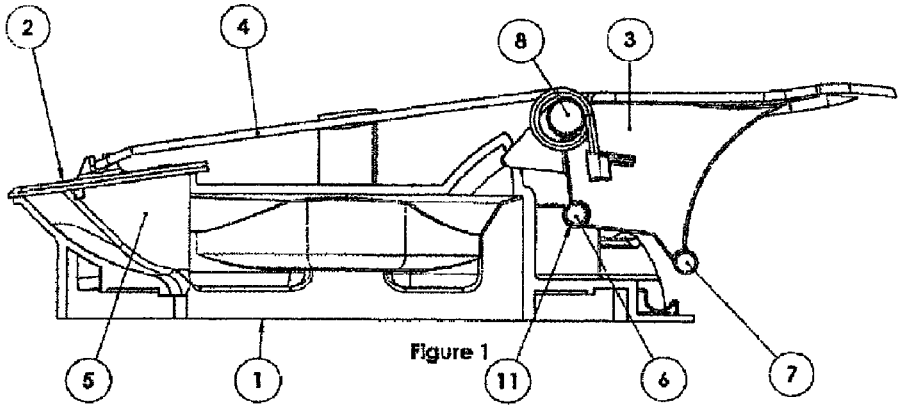
FIGS. 1 to 3 show in the form of diagrammatic cutaway views the movement of the seal of the spout from a closed position to an open position.
Figure 2:
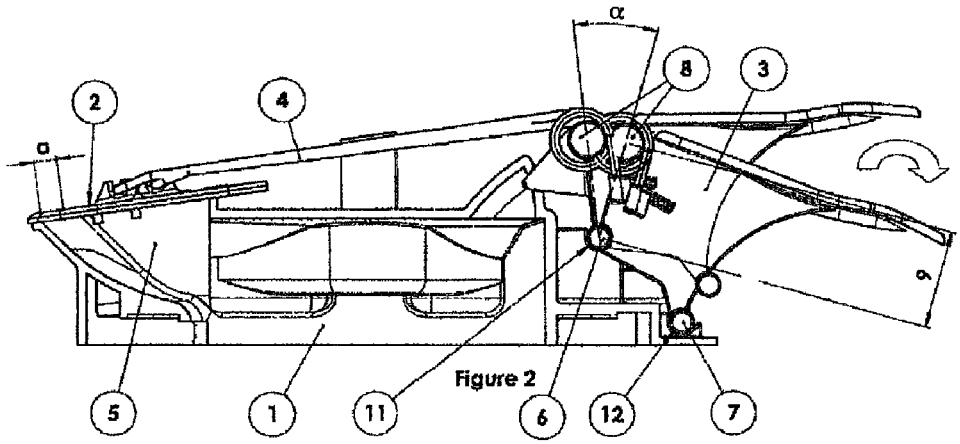
Figure 3:
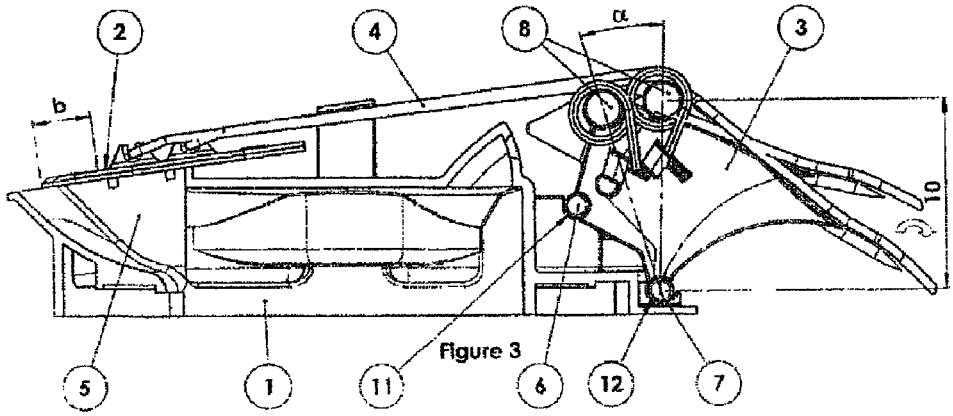

As mentioned above, the cover 1, object of the invention, is designed for the closing of a pot or another container of liquid or particulate product. This precision cover 1 has a spout 5 with a sliding seal 2 that is acted upon by a hairpin spring 4. The motion of this seal 2 is controlled by a pivoting opening lever 3. Additional means are located between spout and lever to create the pressure force of the spring 4, thus making it possible to subject said spring to flexion and torsion. Thus, via the same spring 4, a double action of pressure and automatic closure of the sliding spring 2 is obtained. This combination of thrusts by torsion and by flexion of a single spring resulting from the manual action on a lever ensures both gradual resistance to the opening of the sliding seal for a control of optimum precision on the opening section and a quick closing by total release of the lever while exerting a minimum permanent pressure on the sliding seal to ensure good sealing of the whole.

In a manner that is characteristic of the invention, the pivoting opening lever 3 controls at least two different modes of operation of the sliding seal 2. Thus, in the first mode of operation, for a given angular shift $\alpha$ of the control lever 3, the seal 2 is moved by a small value a relative to the opening of the spout 5. In a second mode of operation, for the same digital value of angular shift $\alpha$ of the control lever 3, the sliding seal 2 is moved by a greater value b relative to the opening of the spout 5. Thus, in a first step, which corresponds to the opening phase of the spout, moving the pivoting lever 3 a long way causes the sliding seal to be moved a short way, thus making it possible to move the seal precisely and to be able to adjust the position of the latter with precision. In addition, the reduction ratio of the movement produced makes it possible to limit the thrust force to be applied to the lever 3 and therefore facilitates the metering. It also makes it possible, in the optional case where the seal 2 sticks to the flange of the spout 5 after an extended period of disuse, to be able to exert a greater separation force on the seal 2. In a second mode of operation, conversely, moving the seal a long way is brought about by moving the lever a short way. This short travel of the lever makes it possible to reduce the total travel of the lever 3 so as to preserve ideal ergonomy, while moving the seal a long way makes possible the quick pouring of a large amount of the contents of the container. Thus, during the total angular shift of the control lever 3, the seal 2, in a first step, is moved by a low value a to provide a small opening of the spout, then, in a second step, by a higher value b, thus providing a large opening of the spout. For all of these movement phases, the seal 2 is always slid on the spout.

In the examples shown, the control lever 3 for movement of the sliding seal 2, which works with the spring 4, has two pivots 6, 7 that are separated from one another to create two lever arms 9, 10 of different lengths: one, shown at 9 in the figures, is short to cause the sliding seal 2 to move a short way, and the other, shown at 10 in the figures, is long to cause the seal 2 to move a long way. These two pivots act successively and without discontinuity. These pivots each work with pivot axis bearings that are located in the cover and formed by a single part with the latter. Thus, the pivot 6 is housed in a bearing that is shown at 11 in the figures while the pivot 7 is housed in a bearing that is shown at 12 in the figures.

It should be noted that lever arm, as mentioned above, is defined as the distance that separates the pivot 6 or 7 from the lever 3 and the attachment point of the spring 4 to the lever 3. Actually, the lever 3, which assumes the general shape of a trigger, is equipped with two studs that are shown at 8 in the figures. These studs that extend along a line that is parallel to the pivot axes 6, 7 are used in the attachment of the spring 4 that connects the sliding seal 4 to said lever. The strands of the hairpin spring 4 are wound on the studs 8 that are formed at the lever and are housed at their other end inside slots that are located on the face of the top of the seal 2.

During actuation of the lever 3 in the direction of an opening of the sliding seal 2, the strands of the spring 4 slide under permanent tensioning means of the spring moving the seal 2 in the direction of an opening of the spout 5. As soon as the lever 3 is released, the spring 4 brings the sliding seal 2 into the closed position of the spout. During the opening phase, in the first mode of operation, the first pivot 6 of the lever 3 works with its bearing 11 to cause a movement of low value, shown, for example, a, of the seal 2 for a given travel that corresponds to, for example, the angle $\alpha$of said lever with less effort because of the increase in the reduction ratio.

In this first mode of operation, an evolution that is gradual and precisely controllable of the surface area of the opening of the spout based on the travel of the seal 2 is obtained.

In a second step, in the second mode of operation, it is the pivot 7 that rests in its bearing 12 to allow the continuation of a movement of high value, for example, b, of the seal 2 for a given travel that corresponds to, for example, $\alpha$ of the lever. The movement that is brought about for the same angular value of travel of the lever produces a longer movement of the sliding seal 2 that causes a large opening of the spout in the second mode of operation compared with the first mode of operation.

Figure 4:
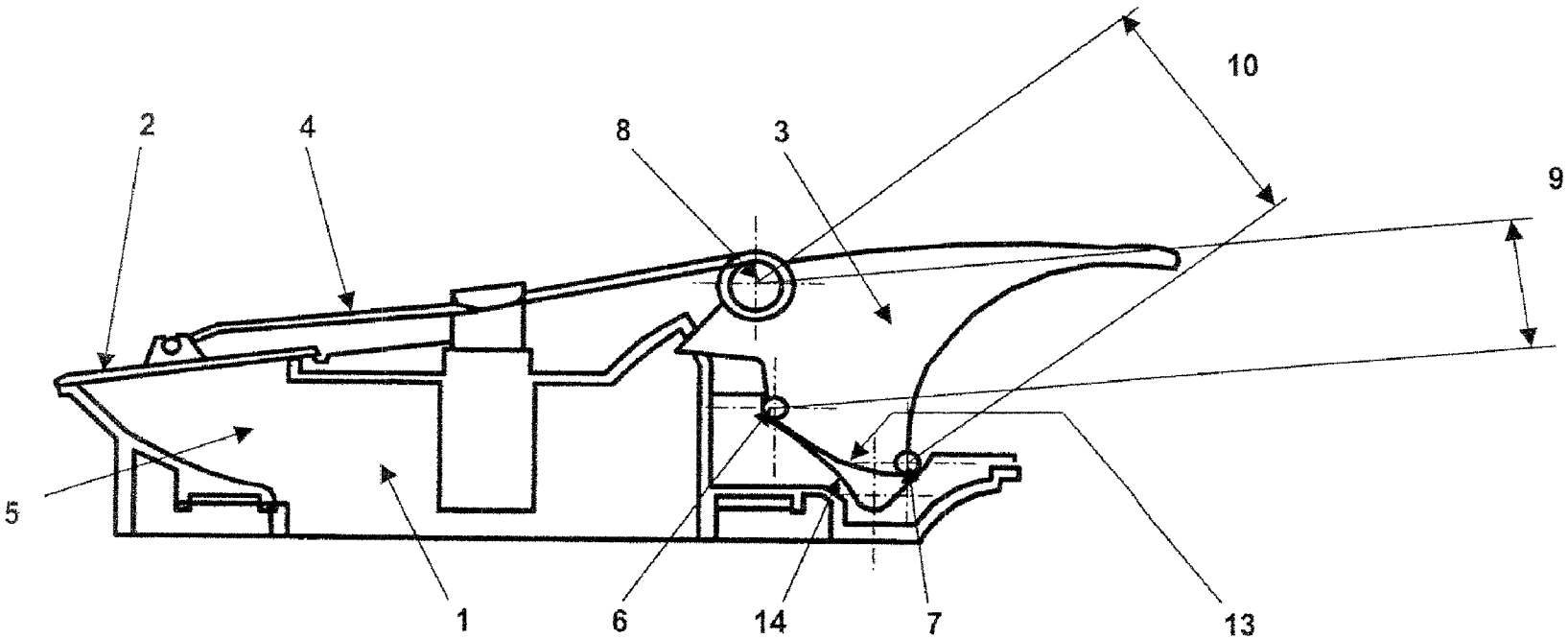
FIG. 4 shows a cutaway view of another embodiment of a closing cover according to the invention.

In another embodiment, according to the one that is shown in FIG. 4, there can be provided, between the two pivot points 6, 7, a cam 13 that works with a stationary cam groove 14 that originates from the cover so as to obtain, during the command for movement of the pivoting control lever, a smooth and gradual transition between the two extreme modes of operation. The minimum lever arm 9, defined between the pivot 6 and the axis of the stud 8 for holding the spring 4 evolves gradually and proportionally to the shape of the groove of the cam 14 that is located on the cover 1 that works with the cam 13 that is located on the lever 3 to end at a value that is equal to the maximum lever arm 10. This progressiveness of the evolution of the lever arm can be linear or variable, based on the shape of the cam and the groove of the cam and on the desired effect.

In one variant (not shown) of the embodiment shown in FIG. 4, a rack-type set of teeth that prevents any sliding of the cam 13 relative to the cam groove 14 can be provided at the cam 13 and the cam groove 14.

The invention claimed is:

1. A precision cover (1) for closing a container of liquid or particulate product, wherein a top of the cover (1) forms a spout (5) with a sliding seal (2) configured to slide against the spout (5) and connected to a spring (4), a sliding motion of the sliding seal (2) against the spout (5) controlled by a pivoting opening lever (3), wherein the pivoting opening lever (3), in a first mode, controls the sliding seal (2) such that the sliding seal (2) slides against the spout (5) by a low value (a) relative to an opening of the spout (5) via an angular shift ($\alpha$) of the pivoting opening lever (3) so as to enable an operator to meter a flow rate of contents of the container with very high precision, and wherein the pivoting opening lever (3), in a second mode, controls the sliding seal (2) such that the sliding seal (2) slides against the spout (5) by a higher value (b) relative to the opening of the spout (5) via the angular shift ($\alpha$) of the pivoting opening lever (3) so as to enable an operator to meter a flow rate of the contents of the container with a high value of opening.

2. The precision cover (1) according to claim 1, wherein during a total angular shift of the pivoting opening lever (3), the seal (2) is moved in a first step by the low value (a) to provide a small opening, then, in a second step, by the higher value (b).

3. The precision cover (1) according to claim 1, wherein the pivoting opening lever (3) has two pivots (6, 7) that are separated from one another to create two lever arms (9, 10) of different lengths, wherein a first of the lever arms (9) is short to cause a short movement of the sliding seal (2), and wherein the second of the lever arms (10) is long to cause a long movement of the seal (2).

4. The precision cover (1) according to claim 3, wherein the pivoting opening lever (3) includes a cam (13) between the two pivots (6, 7) configured to operate with a stationary cam groove (14) provided on the precision cover so as to obtain, during a movement of the pivoting opening lever (3), a smooth transition between the two modes of operation.

5. The precision cover (1) according to claim 4, wherein a rack-type set of teeth is provided on the face of the cam (13) of the pivoting opening lever (3) and the stationary cam groove (14) of the cover is configured to prevent any sliding of one part relative to another during the movement of the pivoting opening lever (3)

6. A precision cover (1) for closing a container of liquid or particulate product, comprising:

a top portion forming a spout (5);

a sliding seal (2) configured slide against the spout (5) of the top portion to reversibly seal the spout (5);

a spring (4) connected to the sliding seal (2); and a pivoting opening lever (3) connected to the sliding seal (2) via the spring (4) for actuating the sliding seal (2) on the spout (5), wherein, in a first operational mode of the pivoting opening lever (3), a first angular shift ($\alpha$) of the pivoting opening lever (3) causes the sliding seal (2) to slide from a closed position on the spout (5) by a first distance having a low value (a) relative to an opening of the spout (5), and wherein, in a second operational mode of the pivoting opening lever (3), a second angular shift ($\alpha$) of the pivoting opening lever (3), equal in magnitude to the first angular shift ($\alpha$), causes the sliding seal (2) to slide from the closed position on the spout (5) by a second distance having a higher value (b) relative to the opening of the spout (5), said higher value (b) being greater than said lower value (a).

7. The precision cover (1) according to claim 6, wherein during a total angular shift of the pivoting opening lever (3), the seal (2) is displaced in a first step by the first distance to provide a first small opening, followed by a second step whereupon the seal (2) moves by the second distance.

8. The precision cover (1) according to claim 6, wherein the pivoting opening lever (3) comprises first and second pivots (6, 7), said first and second pivots (6, 7) being spaced apart to create two lever arms (9, 10) of different lengths, wherein the first of the lever arms (9) is shorter than the second of the lever arms (10) such that the first of the lever arms is configured to cause a short first movement of the sliding seal (2), and the second of the lever arms (10) is configured to cause a long second movement of the seal (2), the second movement of the seal (2) being longer than the first movement of the sliding seal (2).

9. The precision cover (1) according to claim 8, further comprising:

a stationary cam groove (14); and a cam (13) on the pivoting opening lever and positioned between the two pivots (6, 7) of the pivoting opening lever (3), wherein the cam (13) is configured to operate with the stationary cam groove (14) so as to obtain, during a movement of the pivoting opening lever (3), a smooth transition between the first and second modes of operation.

10. The precision cover (1) according to claim 9, wherein the cam (13) of the pivoting opening lever (3) comprises a face and a rack-type set of teeth on said face, and wherein the stationary cam groove (14) operates with the rack-type set of teeth to prevent any sliding of one part relative to another during the movement of the pivoting opening lever (3).

* * * * *